US006568474B2

(12) United States Patent
George et al.

(10) Patent No.: US 6,568,474 B2
(45) Date of Patent: May 27, 2003

(54) RIGLESS ONE-TRIP PERFORATION AND GRAVEL PACK SYSTEM AND METHOD

(75) Inventors: Kevin R. George, Burleson, TX (US); Stanley Wall, Houston, TX (US); Marvin Bryce Traweek, Houston, TX (US); Barry Ed Smith, Carencro, LA (US); David Joseph Walker, Lafayette, LA (US); David A. Hebert, Lafayette, LA (US)

(73) Assignee: BJ Services, USA, Houston, TX (US)

( * ) Notice: Subject to any disclaimer, the term of this patent is extended or adjusted under 35 U.S.C. 154(b) by 0 days.

(21) Appl. No.: 09/818,298

(22) Filed: Mar. 27, 2001

(65) Prior Publication Data

US 2002/0062960 A1 May 30, 2002

Related U.S. Application Data

(63) Continuation-in-part of application No. 09/467,363, filed on Dec. 20, 1999, now Pat. No. 6,206,100.

(51) Int. Cl.[7] ..... E21B 43/08; E21B 43/11

(52) U.S. Cl. ..... 166/278; 166/297; 166/55.1

(58) Field of Search ..... 166/278, 297, 166/298, 55, 55.1, 55.2

(56) References Cited

U.S. PATENT DOCUMENTS

| | | | | |
|---|---|---|---|---|
| 4,140,188 A | | 2/1979 | Vann | |
| 4,372,384 A | | 2/1983 | Kinney | |
| 4,526,233 A | | 7/1985 | Stout | |
| 4,540,051 A | | 9/1985 | Schmuck et al. | |
| 4,566,538 A | | 1/1986 | Peterson | |
| 4,574,883 A | | 3/1986 | Carroll et al. | |
| 4,606,408 A | | 8/1986 | Zunkel et al. | |
| 4,627,488 A | | 12/1986 | Szarka | |
| 5,107,943 A | * | 4/1992 | McQueen et al. | 175/267 |
| 5,301,755 A | | 4/1994 | George et al. | |
| 5,303,772 A | | 4/1994 | George et al. | |
| 5,366,014 A | | 11/1994 | George | |
| 5,370,186 A | | 12/1994 | Ireland | |
| 5,398,760 A | | 3/1995 | George et al. | |
| 5,423,382 A | | 6/1995 | Barton et al. | |
| 5,429,192 A | | 7/1995 | Huber et al. | |
| 5,458,196 A | | 10/1995 | George et al. | |
| 5,462,117 A | * | 10/1995 | Green et al. | 166/297 |
| 5,490,563 A | | 2/1996 | Wesson et al. | |
| 5,669,448 A | | 9/1997 | Minthorn et al. | |
| 5,954,133 A | | 9/1999 | Ross | |
| 6,206,100 B1 | * | 3/2001 | George et al. | 166/278 |
| 6,286,598 B1 | * | 9/2001 | van Petegem et al. | 166/297 |

* cited by examiner

*Primary Examiner*—Frank Tsay
(74) *Attorney, Agent, or Firm*—Baker Botts L.L.P.

(57) ABSTRACT

A method of perforating and gravel packing a wellbore casing, having the following steps: (1) making-up to a pipe string: a packer, a screen, and a perforating apparatus; (2) running-in the pipe string until the perforating apparatus is at a depth of intended perforations; (3) setting the perforating apparatus in the wellbore casing at a depth of intended perforations; and (4) disconnecting the screen and perforating apparatus from the pipe string. A system for perforating and gravel packing a wellbore casing, having: a packer which is mechanically communicable with a service string: a screen in mechanical communication with the packer; a perforating apparatus in mechanical communication with the screen, wherein the screen and perforating apparatus are detachable from the packer; and a tool having at least one casing engaging slip segment, wherein the tool is matable with the perforating apparatus, and wherein the tool is settable in the wellbore casing.

17 Claims, 15 Drawing Sheets

RIGLESS ONE-TRIP PERFORATION AND GRAVEL PACK SYSTEM AND METHOD

CONTINUATION STATEMENT

This application is a Continuation-in-Part of U.S. patent application Ser. No. 09/467,363, filed Dec. 20, 1999, now U.S. Pat. No. 6,206,100.

BACKGROUND OF THE INVENTION

The present invention relates to apparatuses and methods for the completion of mineral production wells. In particular, the invention is related to a perforating and gravel packing system and method.

Modern oil and gas wells are typically equipped with a protective casing which is run into the wellbore. Production tubing is then run into the casing for producing minerals from the well. Adjacent the production zones, the protective casing is perforated to allow production fluids to enter the casing bore. Since particles of sand are typically carried with the mineral from the production zone into the casing, it is sometimes necessary to install a gravel pack or production screen to filter the particles of sand. Therefore, it is common practice to complete a mineral well in two steps: (1) run-in the well with a perforating gun to perforate the casing; and (2) run-in the well with a gravel pack tool to gravel pack and/or isolate the perforated zone. However, this method is disadvantageous because it requires multiple trips into the well to perforate and gravel pack the zone.

To reduce the required number of trips into the wellbore casing, various single trip perforation/gravel packing devices have been developed. For example, as described in U.S. Pat. No. 4,372,384, incorporated herein by reference, a single trip apparatus for completing a formation in a case borehole is disclosed. The patent teaches the use of a tool string which includes a perforating gun, gravel packing tools and a packer means. The casing is perforated by running a gun firing device down through the tubing string. The well is allowed to flow freely to clean up the perforated formation. The system is then moved to position a sandscreen of the gravel packer adjacent the perforations and packers are used at each end of the screen to straddle and pack off the perforated pay zone. With the screen and packers in position, a gravel pack is established in the annulus between the perforated casing and the screen. The tool screen is left downhole in the casing as a permanent completion device. The produced fluid is allowed to flow through the perforations, the gravel, screen, and finally up through the tubing screen to the surface.

An alternative well completion system is disclosed in U.S. Pat. No. 5,954,133, incorporated herein by reference. In particular, a method of displacing a perforating gun in a well bore is used to perforate multiple zones without the need to unset or reset a packer. Multiple perforating guns in a positioning device are configured in an axially compressed configuration. The perforating guns are attached to the positioning device and inserted into the wellbore. With a first perforating gun positioned adjacent a first zone, the gun is fired to perforate the casing. The positioning device is then extended to axially displace a second perforating gun within the casing to a position adjacent a second zone. The second gun is then fired to perforate the casing. After a zone(s) has been perforated, the positioning device is further axially extended to displace a production screen and packer. The production screen is positioned adjacent the perforations and the packer is positioned opposite the perforations.

U.S. Pat. No. 5,722,490, incorporated herein by reference, discloses a method and system wherein a gravel pack screen is placed in the well along with equipment in the tubing string to control flow from inside to outside the tubing below a production packer. The rig used to place the equipment may then be released from the well. The well is then hydraulically fractured. If the well is producing from a high permeability zone, the hydraulic fracture is preferably formed with the tip screen-out technique. The method can also be used in a well already containing production tubing without moving a rig on the well to remove the tubing from the well and can be used in a well not yet perforated by adding tubing-conveyed perforating apparatus below the screen.

As illustrated in some of the above referenced patent documents, in traditional one-trip systems, the perforating gun assembly is mechanically connected to the gravel pack assembly during run-in and perforating operations. A basic problem with traditional one-trip perforation/gravel packing systems is that the gravel packing portions of the system are damaged when the guns of the perforation portion of the system are detonated. In particular, a major factor affecting the reliability of one-trip perforation/gravel packing systems is the effects of gunshock on the gravel pack assembly. This shock loading can be in the form of a mechanical force which is communicated through a pipe string or similar structure connecting the perforating guns to the gravel packing assembly. Alternatively, a pressure wave created during detonation in the fluid column inside the wellbore casing can damage the gravel packing apparatus due to a shock effect It has been very difficult to predict the size of this shock effect and even more difficult to prevent it.

Therefore, there is a need for a one-trip perforation/gravel packing system which is more reliable than traditional systems in that the gravel packing portion of the system is protected from shock waves generated by the guns of the perforating portion of the system.

SUMMARY OF THE INVENTION

The present invention is a system and method of operation which performs both the perforating and gravel packing operations during a single-trip into a wellbore, and which also protects the gravel packing portion of the system from becoming damaged when the guns of the perforating portion of the system are detonated. The process that is described here represents a novel approach which involves a modification to traditional performing/gravel pack systems to eliminate the effects of gun shock on the gravel pack apparatus.

The present invention involves running the perforating apparatus into the wellbore on the same pipe string as the gravel pack assembly and anchoring the perforating apparatus to the wellbore. The perforating apparatus is then decoupled from the gravel pack assembly and the gravel pack assembly is picked up above the perforating apparatus. This accomplishes two things. First, mechanical shock is eliminated because the guns are no longer in mechanical contact with the gravel pack assembly. Mechanical shock is further dampened because the perforating apparatus is anchored into the wellbore. Second, the effects of a pressure wave are eliminated due to the dampening effect of the fluid column that exists between the top of the perforating apparatus and the bottom of the gravel pack assembly which is pulled away from and set above the perforating apparatus. Upon detonation, the guns and anchor device of the perforating apparatus are released or unset from the casing and are allowed to free fall or be pushed to the bottom of the wellbore. With the guns released from the wellbore casing, the gravel pack assembly is repositioned across the perforated zone. Sand control and stimulation treatments are then conducted to complete the well.

According to one aspect of the invention, there is provided a method of perforating and gravel packing a wellbore casing, the method comprising: making-up to a pipe string, a gravel packer assembly and a perforating apparatus; running-in the pipe string until the perforating apparatus is at a depth of intended perforations; and setting the perforating apparatus in the wellbore casing at a depth of intended perforations; and disconnecting the perforating apparatus from the pipe string.

According to a further aspect of the invention, there is provided a system for perforating and gravel packing a wellbore casing in a single trip into the wellbore, the system comprising: a gravel packer assembly having a production screen and at least one packer; a perforating apparatus connected to the gravel packer assembly, wherein the perforating apparatus is detachable from the gravel packer assembly after the system is placed in the wellbore and before a detonation of the perforating apparatus; a tool having at least one casing engaging slip segment, wherein the tool is matable with the perforating apparatus, and wherein the tool is settable in the wellbore casing.

According to still another aspect of the invention, there is provided a system for perforating and gravel packing a wellbore casing in a single trip into the wellbore, the system comprising: a gravel packer assembly having a production screen and at least one packer, wherein the gravel packer assembly is connected to a pipe string for running the system into the wellbore; a perforating apparatus connected to the gravel packer assembly, wherein the perforating apparatus is detachable from the gravel packer assembly after the system is placed in the wellbore and before a detonation of the perforating apparatus; a tool having at least one casing engaging slip segment, wherein the tool is matable with the perforating apparatus, and wherein the tool is settable in the wellbore casing; a release mechanism that releases the tool from being set in the wellbore casing; and a tube that extends between the gravel packer assembly and the perforating apparatus, whereby a drop bar is guided from the gravel packer to the perforating apparatus.

An aspect of the invention provides a method of perforating and gravel packing a wellbore casing, having the following steps: (1) making-up to a pipe string: a packer, a screen, and a perforating apparatus; (2) running-in the pipe string until the perforating apparatus is at a depth of intended perforations; (3) setting the perforating apparatus in the wellbore casing at a depth of intended perforations; and (4) disconnecting the screen and perforating apparatus from the pipe string.

Another aspect provides a system for perforating and gravel packing a wellbore casing, having: a packer which is mechanically communicable with a service string: a screen in mechanical communication with the packer; a perforating apparatus in mechanical communication with the screen, wherein the screen and perforating apparatus are detachable from the packer; and a tool having at least one casing engaging slip segment, wherein the tool is matable with the perforating apparatus, and wherein the tool is settable in the wellbore casing.

The invention has a further aspect, including a system for perforating and gravel packing a wellbore casing, having: a packer connectable to a pipe string for running the system into the casing, wherein the packer has a through path extending from a top end to a bottom end of the packer; a screen comprising a production screen and a vent screen, wherein the screen mechanically communicates with the packer; a perforating apparatus in mechanical communication with the packer, wherein the perforating apparatus and the screen are detachable from the packer; and a tool comprising at least one casing engaging slip segment and a release mechanism, wherein the tool is matable with the perforating apparatus, and wherein the tool is settable in the wellbore casing.

BRIEF DESCRIPTION OF THE DRAWINGS

The present invention is better understood by reading the following description of non-limitative embodiments with reference to the attached drawings wherein like parts in each of the several figures are identified by the same reference characters, and which are briefly described as follows.

As shown in FIG. 5, the perforating gun has detonated to perforate the wellbore casing and the depth verification tool has released or unset from the casing so that the depth verification tool and perforating apparatus have fallen to a position below the perforations.

It is to be noted, however, that the appended drawings illustrate only typical embodiments of this invention and therefore not to be considered limiting of its scope, as the invention may admit to other equally effective embodiments.

DETAILED DESCRIPTION OF THE INVENTION

According to a first embodiment of the invention, a depth verification tool is anchored in a wellbore casing at a depth adjacent a mineral production zone. A gravel packer assembly and a perforating apparatus are then run-in the casing on a single pipe string. The perforating apparatus is deposited on the depth verification tool and secured thereto. The perforating apparatus is detached from the pipe string and the pipe string is used to reposition the gravel packer assembly to a location separate from and above the perforating apparatus. A perforation packer at a lower end of the gravel packer assembly is then set in the wellbore casing. With the gravel packer assembly secured, perforating guns of the perforating apparatus are detonated to perforate the casing. Upon detonation, the depth verification tool and perforating apparatus are released or unset from the casing and allowed to fall to the bottom of the well. The perforation packer at the lower end of the gravel packer assembly is then released and the gravel packer assembly is repositioned to straddle the perforations in the casing. The packers of the gravel packer assembly are set and complete operations are conducted on the production zone.

Figure 1:
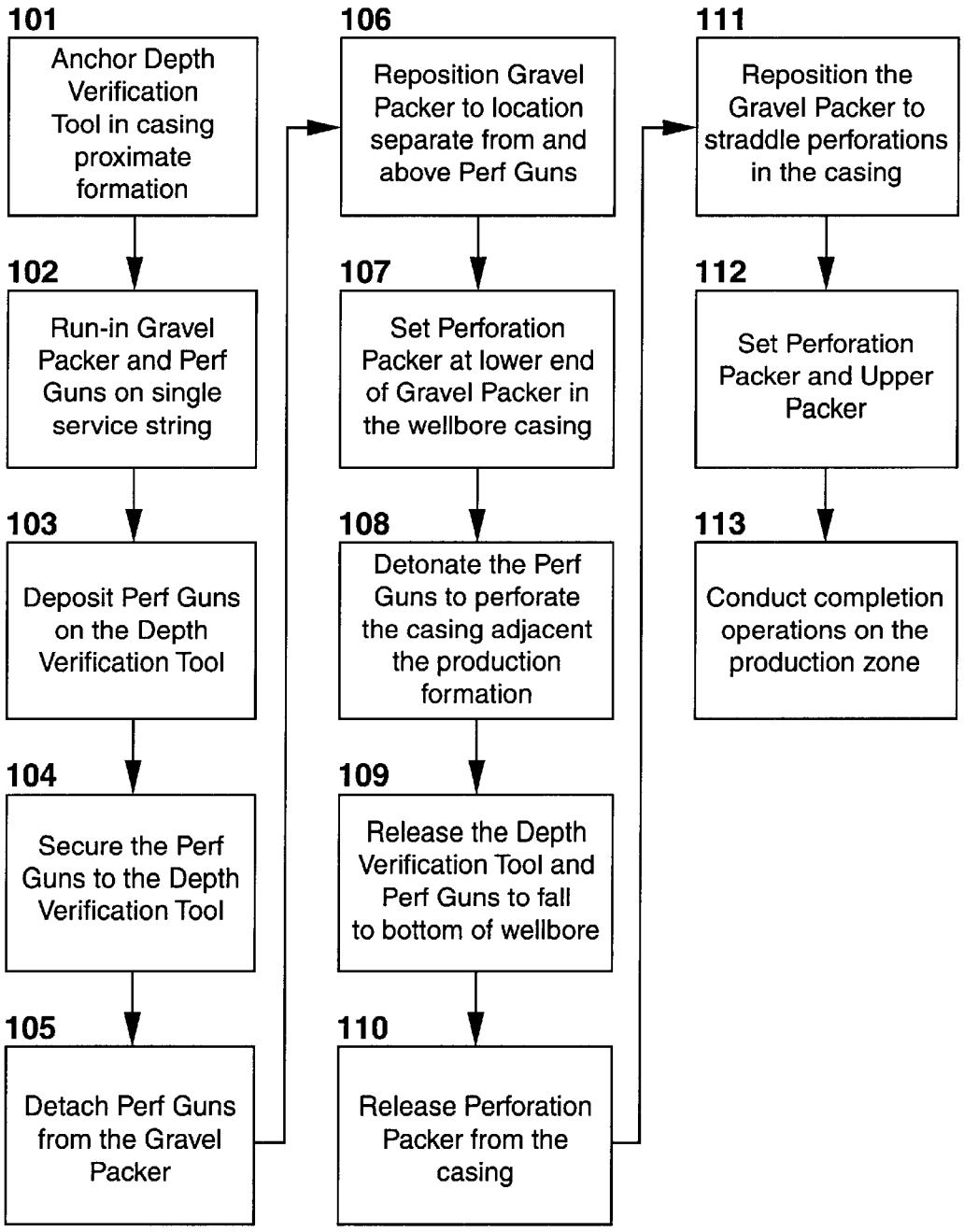
FIG. 1 is a flow chart of a method embodiment of the invention for perforating and gravel packing a wellbore casing.

This method embodiment of the invention is described in greater detail with reference to FIGS. 1 through 6. Referring to FIG. 1, a flowchart of a method for operation of a particular embodiment of the present invention is shown. FIGS. 2 through 6 illustrate cross sectional views of downhole tools in a wellbore casing at various stages of the method described in FIG. 1.

Figure 2:
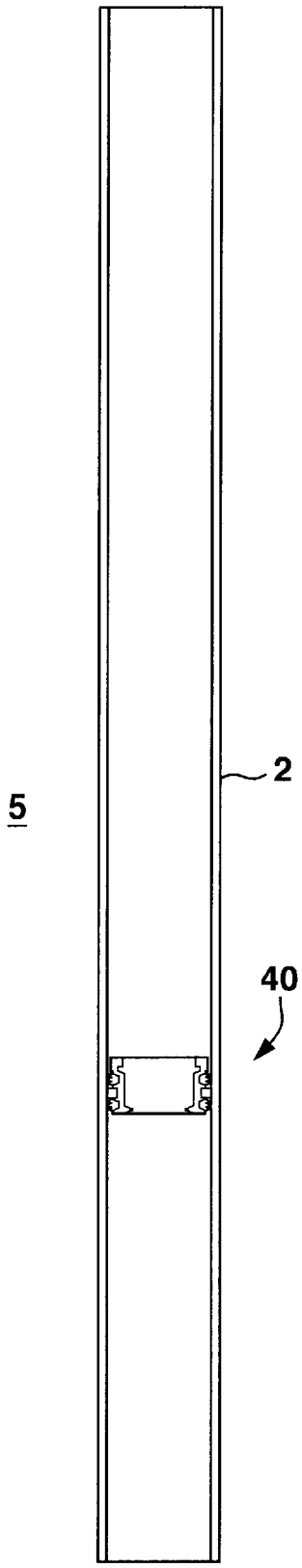
FIG. 2 is a sideview of a wellbore casing and a depth verification tool anchored in the casing.

The first step of the process is to anchor 101 a depth verification tool 40 in a wellbore casing 2. As shown in FIG. 2, the depth verification tool 40 is anchored 101 at a depth and location which is proximate to a production formation 5 outside the casing 2. The depth verification tool 40 may be lowered to this location by any means known to those of skill in the art. For example, the depth verification tool 40 may be lowered in the well casing 2 by a wireline, coil tubing or a pipe string. According to different embodiments of the invention, the depth verification tool 40 is set above, below, or in the interval of the wellbore casing 2 which spans the production formation 5.

Figure 3:
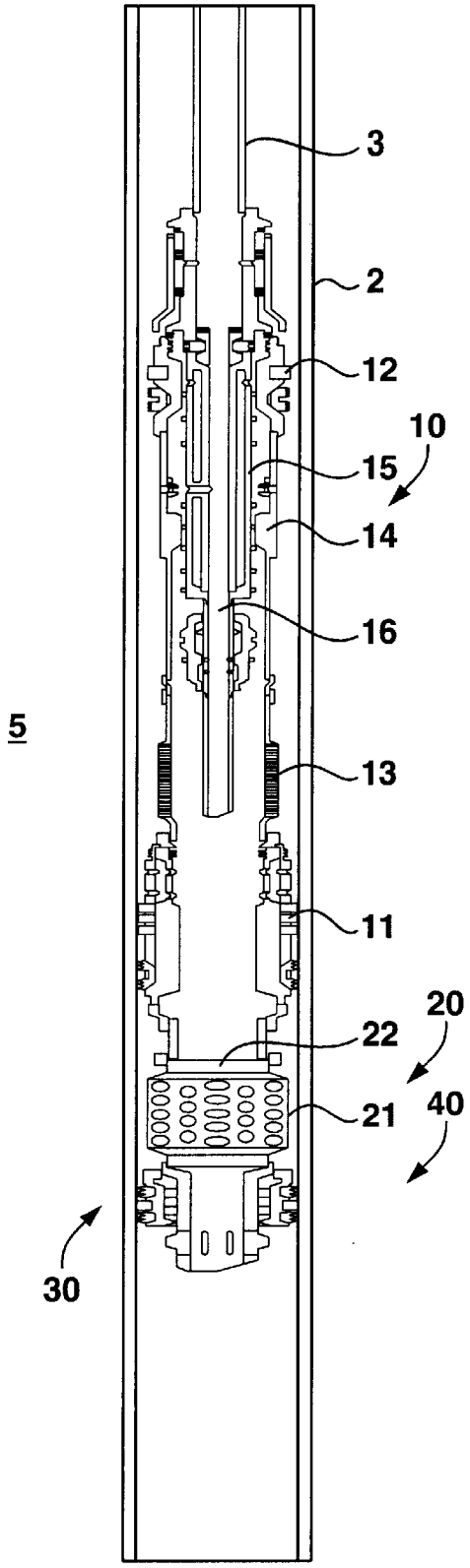
FIG. 3 is a sideview of a wellbore casing and depth verification tool anchored in the casing. Further, a gravel packer assembly and perforating apparatus are shown suspended from a pipe string in the well casing above the depth verification tool.

With further reference to FIG. 3, a gravel packer 10, a perforating apparatus 20, and a release mechanism 30 are run-in 102 the wellbore casing 2 on a pipe string 3. The gravel packer 10 is equipped with a perforating packer 11 at its lower end and an upper packer 12 at its upper end. Between the packers 11 and 12, the gravel packer 10 has a production screen 13. Finally, the gravel packer 10 has a fracturing sleeve 14 and a cross-over tool 15. According to various embodiments of the invention, nearly any gravel packer apparatus may be used with the invention. For example, the isolation and gravel packing systems disclosed in U.S. Pat. Nos. 5,609,204 and 5,865,251, incorporated herein by reference, are suitable for use with the present invention. The perforating apparatus 20 comprises a gun cylinder 21 and detonator 22. The gun cylinder 21 is positioned with its longitudinal axis collinear with the central axis of the wellbore casing 2. Perforating guns are located about the circumference of the gun cylinder 21 as is known in the perforating gun art. The detonator 22 is located at the top of the perforating apparatus 20 where the perforating apparatus is made-up to the bottom of the gravel packer 10. The system is further equipped with a release mechanism 30 which is made-up to the bottom of the perforating apparatus 20. The release mechanism 30 is configured to extend into the depth verification tool 40 and mate therewith.

As shown in FIG. 3, system is run-in 102 the wellbore casing 2 until the release mechanism 30 and perforating apparatus 20 are deposited 103 on the depth verification tool 40. The perforating apparatus 20 is then secured 104 to the depth verification tool 40 by the release mechanism 30. In an alternative embodiment of the invention, the release mechanism 30 is separate from the latching mechanism that attaches the perforating apparatus 20 to the depth verification tool 40. The depth verification tool 40 is anchored into the casing 2 and a standard anchor latch assembly (not shown) is used to anchor the perforating apparatus 20 to the depth verification tool 40. The release mechanism 30 is a separate tool that is threaded to the anchor latch or the perforating apparatus 20 depending on the particular application.

Figure 4:
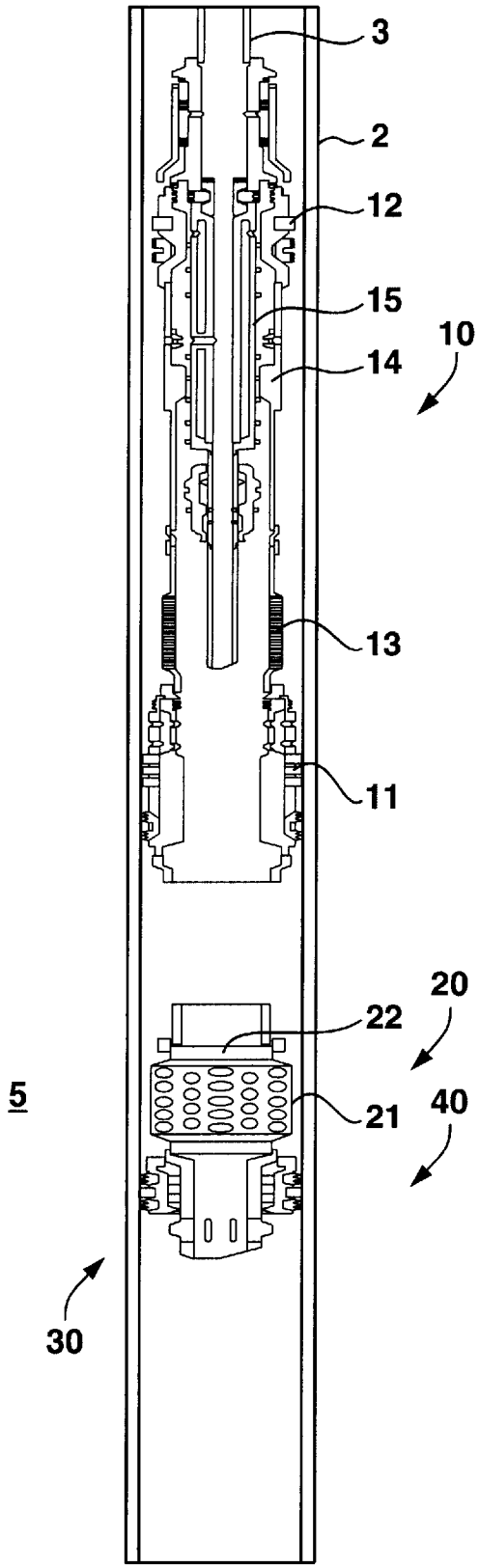
FIG. 4 is a sideview of a wellbore casing with an anchored depth verification tool, perforating apparatus and gravel packer assembly. The perforating apparatus is secured to the depth verification tool and detached from the gravel packer assembly. Further, this figure shows the gravel packer assembly elevated to a position well above the perforating guns and a lower packer is set within the wellbore casing.

With particular reference to FIG. 4, once the perforating apparatus 20 is secured 104 to the depth verification device 40, the gravel packer 10 is detached 105 from the perforating apparatus 20. In alternative embodiments, the perforating apparatus 20 is connected to the gravel packer 10 by a "J-coupling" and the perforating apparatus 20 is detached 105 by an "un-J" procedure as is known in the art. The gravel packer 10 is then repositioned 106 to a location separate from and above the perforating apparatus 20 by pulling up on the pipe string 3. The gravel packer 10 is repositioned 106 to a location between about 100 meters and about 200 meters separate from the perforating apparatus 20. Once the gravel packer 10 is repositioned 106, the perforation packer 11 is set 107 in the wellbore casing 2. By setting the perforation packer 11, the gravel packer 10 is secured in the wellbore casing 2 to prevent the gravel packer 10 from being damaged during detonation of the perforating apparatus 20. Also, the perforation packer 11 is used to control the well after perforation to prevent fluids from travelling up through the annulus between the casing and the pipe string.

In an alternative embodiment of the invention, the perforation packer 11 is not set 107. This step in the process is unnecessary where the well is perforated in an overbalanced condition. However, the gravel packer assembly 10 is still protected from the detonation shock effects of the perforating apparatus 20 because it is detached and separated from the perforating apparatus 20.

Figure 5:
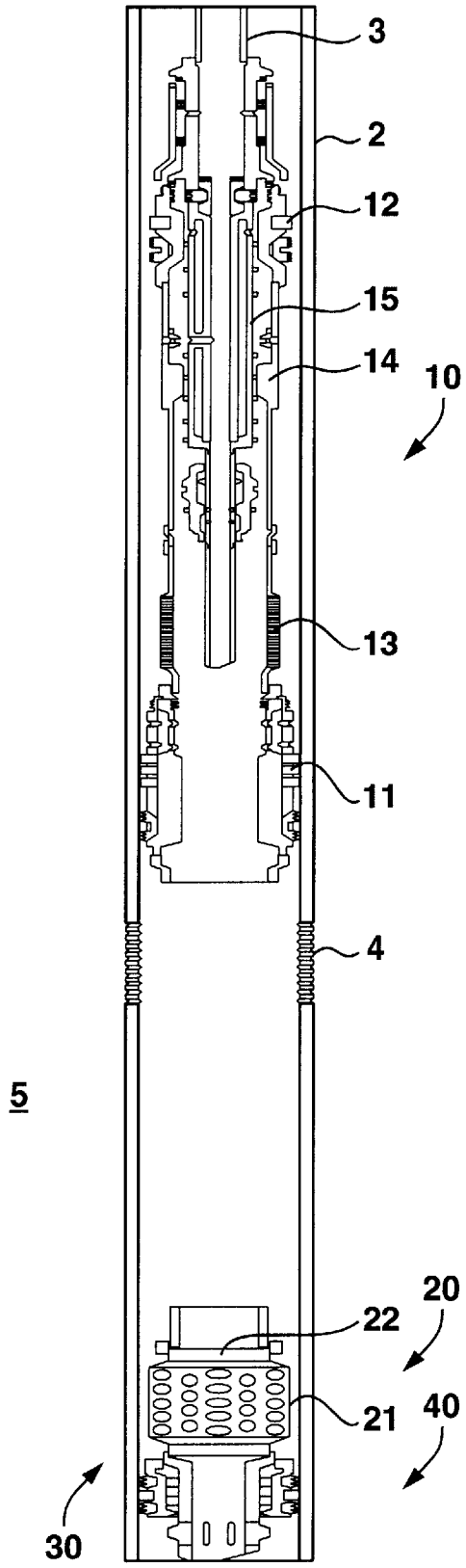
FIG. 5 is a sideview of a wellbore casing with a depth verification tool, perforating apparatus, and gravel packer assembly.

Referring to FIG. 5, a view of the system is shown immediately after detonation of the perforating apparatus 20. With the perforation packer 11 set 107, the perforating apparatus 20 is detonated 108 to perforate the wellbore casing 2. According to various embodiments of the invention, the detonator 22 is triggered by dropping a detonation bar or ball on the detonator, increasing the hydrostatic pressure in the wellbore, sending and electronic signal, or any other triggering mechanism known to those of skill in the art. In one embodiment, the gravel packer assembly 10 has a through path 16 which is large enough to allow a detonation bar or ball to be dropped from the pipe string 3, through the through path 16 to the detonator 22. As the guns of the perforating apparatus 20 are detonated 108, the depth verification tool 40 is released 109 from the wellbore casing 2 to allow the perforating apparatus 20, release mechanism 30 and depth verification tool 40 to fall to the bottom of the wellbore. The release mechanism 30 releases 109 or unsets these tools by deactivating the anchoring device of the depth verification tool 40 as described in greater detail below. Once the depth verification tool 40 is released 109 from the wellbore casing 2, both the perforating apparatus 20 and the depth verification tool 40 are allowed to drop to the bottom of the wellbore.

Figure 6:
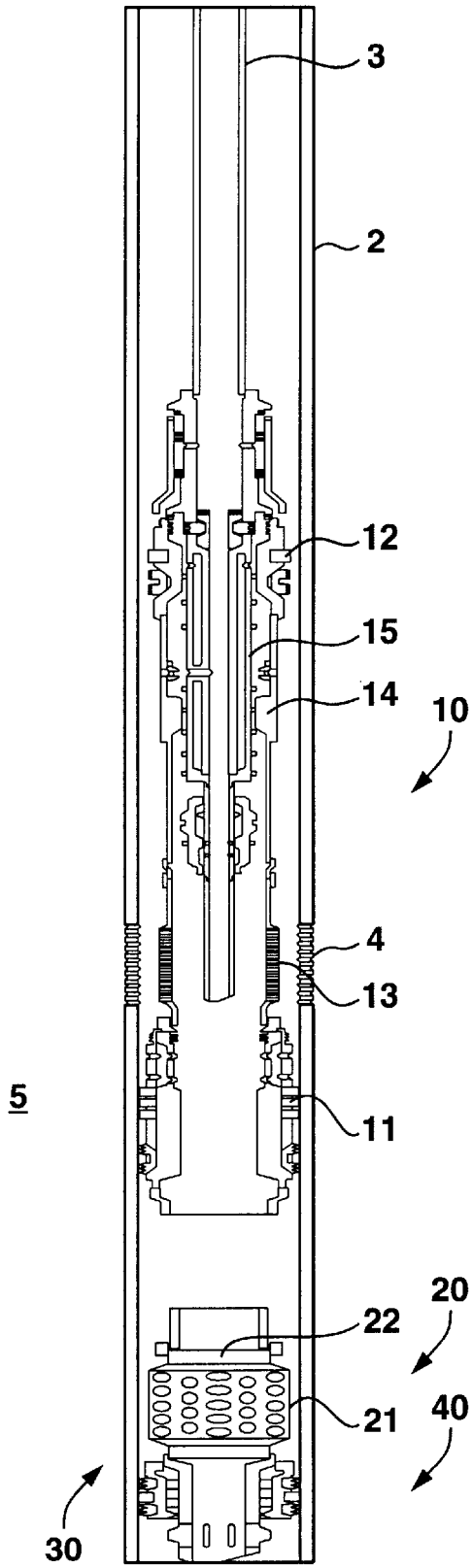
FIG. 6 is a sideview of a wellbore casing wherein a depth verification tool and perforating apparatus have fallen to a low position in the wellbore casing, and a gravel pack assembly is positioned to straddle perforations in the wellbore casing.

Referring to FIG. 6, the perforation packer 11 is then released 110 from the wellbore casing 2. The gravel packer 10 is then repositioned 111 to straddle the perforations in the wellbore casing 2. This repositioning 111 is accomplished by lowering or running the pipe string 3 into the wellbore. The gravel packer 10 is repositioned 111 until the production screen 13 is immediately adjacent the perforations 4. Once the gravel packer 10 is repositioned 111, the perforation packer 11 is set to seal the lower end of the gravel packer 10. The upper packer 12 is also set 112 to seal the upper end of the gravel packer 10. The system is now properly configured to conduct 113 completion operations on the production zone. In embodiments of the invention having a through path 16 through the gravel packer assembly 10, a plug is dropped into the through path 19 to close the through path 16 prior to completion operations.

Referring to FIGS. 4, 5, 6, 7 and 8, an alternative method and apparatus of the invention is described and shown. In this embodiment, the depth verification device 40 is secured to the perforating apparatus 20 before the system is run into the wellbore. Therefore, a gravel packer 10, perforating apparatus 20 and a depth verification tool 40 are all made up together on the surface before running into the wellbore.

Figure 7:
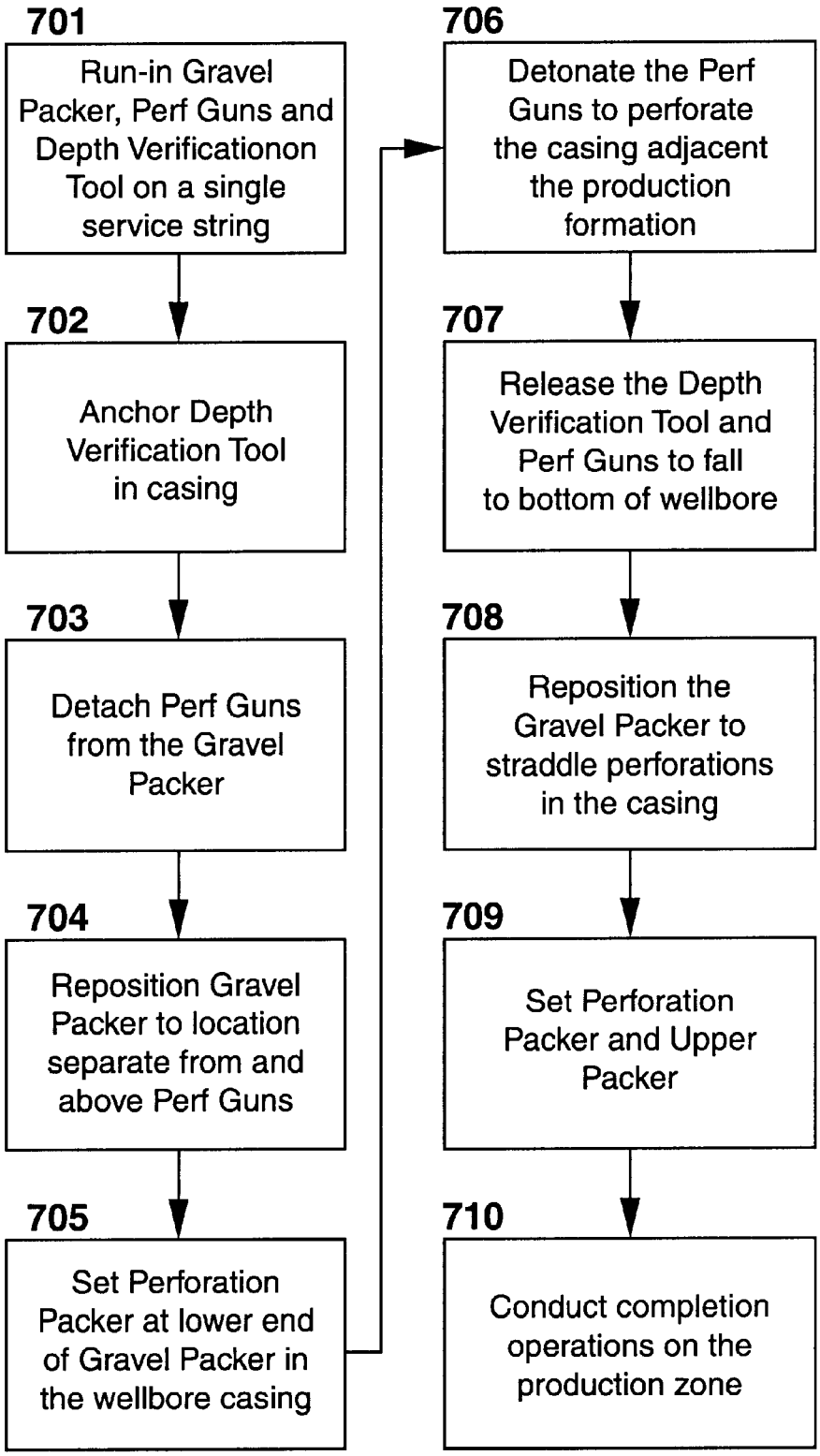
FIG. 7 is a flow chart of a method embodiment of the invention for perforating and gravel packing a wellbore casing.
Figure 8:
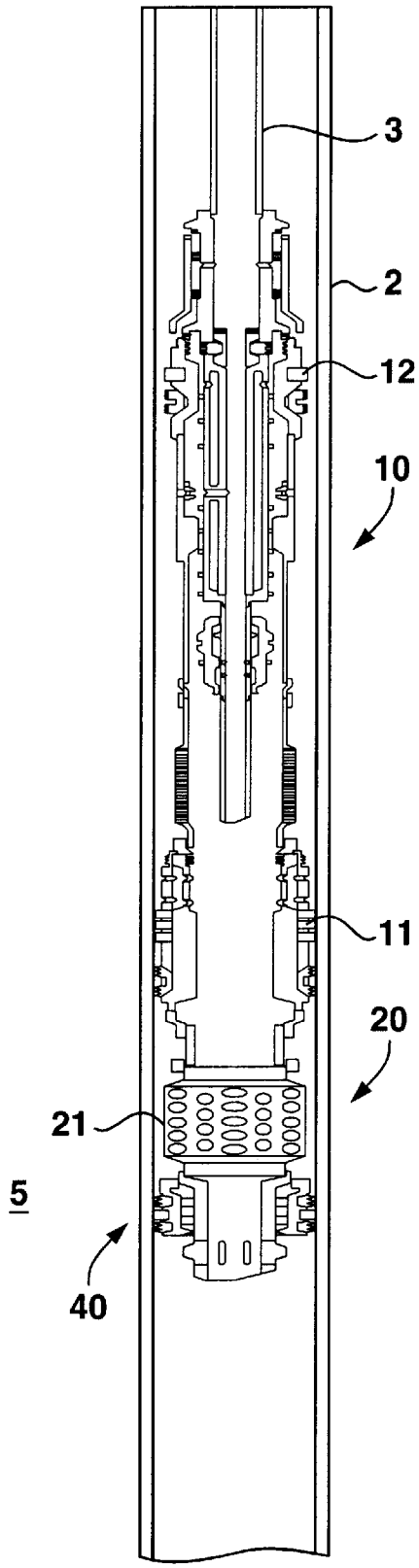
FIG. 8 is a sideview of a wellbore casing and a gravel pack/perforation system, wherein a depth verification tool is attached to a perforating apparatus so that a gravel pack assembly, a perforating apparatus and the depth verification tool are all run-in the well on the same pipe string.

As shown in FIGS. 7 and 8, the gravel packer 10, perforating apparatus 20 and depth verification tool 40 are run-in 701 the wellbore casing 2 on a single pipe string 3. The system is run-in 701 the wellbore until the perforating apparatus 20 is adjacent a mineral production formation 5 on the outside of the wellbore. Once depth has been achieved, the depth verification tool 40 is anchored 702 in the casing 2. The perforating apparatus 20 is then detached 703 from the gravel packer 10. With the perforating apparatus 20 detached 703, the gravel packer apparatus 10 is repositioned 704 to a location separate and uphole from the perforating apparatus 20. A perforation packer 11 of the gravel packer assembly 10 is set 705 to secure the gravel packer assembly 10 against the detonation of the perforating apparatus 20. Next, the guns in the gun cylinder 21 of the perforating apparatus 20 are detonated 706 to perforate the casing. The depth verification device 40 is released 707 or unset from the casing so that the perforating apparatus 20 and depth verification tool 40 will fall to the bottom of the wellbore. The gravel packer assembly 10 is repositioned 708 to straddle the perforations in the casing and the packers 11 and 12 of the gravel packer assembly 10 are set 709 in the casing. The perforation packer 11 and upper packer 12 are set 709 to isolate the annulus between the production screen 13 and casing 2. Completing operations are finally conducted 710 on the perforated portion of the wellbore casing 2.

Figure 9:
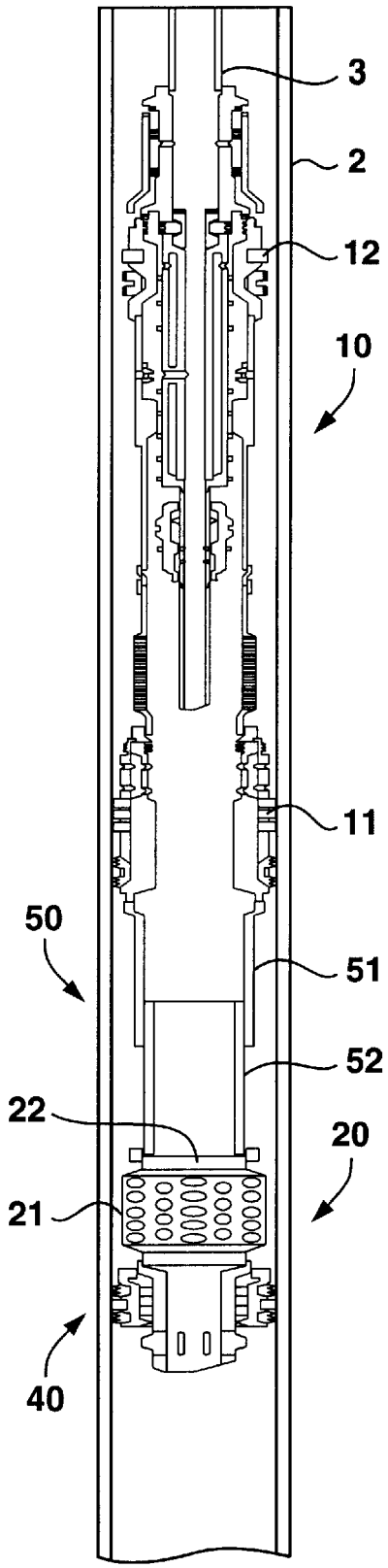
FIG. 9 is a side view of a wellbore casing and gravel pack/perforation system wherein the system comprises a guide tube between a gravel packer assembly and a perforating apparatus. The guide tube ensures a denotation bar dropped through the gravel packer assembly will squarely contact and detonate the perforating apparatus.

An alternative embodiment of the invention is shown in FIG. 9. This embodiment is equipped with a guide tube 50. The guide tube 50 ensures that a detonation bar dropped through the gravel packer 10 will travel through the guide tube 50 and squarely contact the detonator 22 of the perforating apparatus 20. In the embodiment shown, the guide tube 50 is a telescoping mechanism having cylindrical sections which are concentric. Thus, a gravel pack cylinder 51 is attached to the bottom of the gravel packer 20 and a detonation cylinder 52 is attached to the top of the perforating apparatus 20. The cylindrical sections are allowed to slide freely one within the other after the perforating gun is released or detached from the gravel packer 10. These cylindrical sections are allowed to freely slide relative to each other to ensure mechanical vibrations are not transferred from the perforating apparatus to the gravel packer 10.

Figure 10:
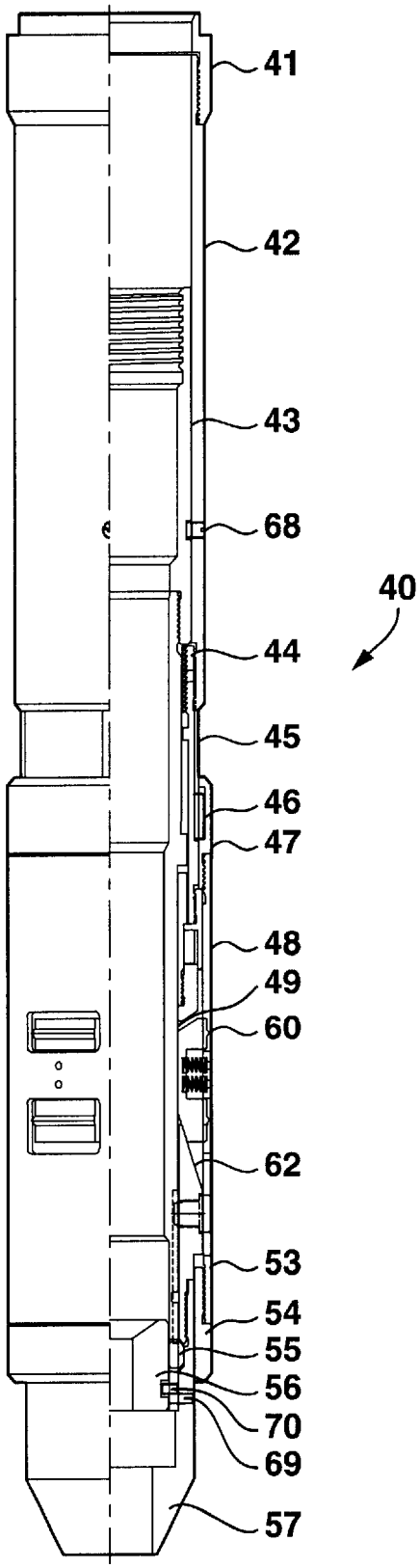
FIG. 10 is a side, cross-sectional view of a depth verification tool.

Referring to FIG. 10, a side cross-sectional view of a depth verification tool 40 is shown. The depth verification tool 40 has exterior and interior sleeves which are both comprised of several independent components. The exterior sleeve has a setting sleeve connector 41 at its upper end. The setting sleeve connector 41 is made-up to a setting sleeve 42. Both of these components make up a portion of the exterior of the depth verification tool 40. The exterior is further comprised of a locking key mandrel 45 that communicates with the bottom of the setting sleeve 42. Below the locking key mandrel 45 is an upper retainer 47 that holds a key 46. The upper retainer 47 is made-up to a slip cage 53, wherein the slip cage 53 extends below the upper retainer 47. Finally, the exterior of the depth verification tool 40 comprises a bottom retainer 54. The interior sleeve has a top coupling 43 near the top of the depth verification tool 40. A mandrel 49 is made-up to the bottom of the top coupling 43 and extends from the top coupling 43 to approximately the bottom of the depth verification tool 40. The depth verification tool 40 is made to be in set and release configurations by manipulating the relative positions of the exterior and interior sleeves.

Toward the top of the depth verification device 40 there is a shear pin(s) 68 which prevents relative axial movement of the setting sleeve 42 and top coupling 43. Toward the bottom, the depth verification tool 40 is further comprised of slip segments 60 for engaging wellbore casing. In the embodiment shown, three slip segments 60 are spaced equal distance from each other around the circumference of the slip cage 53. In alternative embodiments, more or less than three slip segments 60 are used. Slip return springs 61 are placed between the slip segments 60 and the slip cage 53 to bias the slip segments to a non-engaging position. A spacer 48 is positioned between the mandrel 49 and the slip cage 53 above the slip segments 60. A bottom shoe 62 is positioned between the mandrel 49 and the slip cage 53 below the slip segments 60. A release seat catcher 57 is made-up to the bottom of the bottom shoe 62. Dogs 55 are positioned between the release seat catcher 57 and a releasing seat 56. A shear pin(s) 70 extends between the release seat catcher 57 and the releasing seat 56 to prevent relative movement of these members.

The depth verification tool 40 is assembled by sliding the top coupling 43 into the setting sleeve 42 and screwing a shear pin(s) 68 through the setting sleeve 42 into the top coupling 43. The key 46 and the upper retainer 47 are slipped over the locking key mandrel 45 and the body lock ring 44 is placed within the locking key mandrel 45. The locking key mandrel 45 is then made-up to the setting sleeve 42. The mandrel 49 is then made-up to the top coupling 43. The slip segments 60 and slip return springs 61 are assembled to the slip cage 53 and the spacer 48 is placed inside the top of the slip cage 53. The slip cage 53 is then made-up to the upper retainer 47. The bottom shoe 62 is inserted between the slip cage 53 and the mandrel 49. The dogs 55 are then placed in holes found at the lower end of the mandrel 49 and the releasing seat 56 is inserted into the lower end of the mandrel 49 until the releasing seat 56 is adjacent the dogs 55. The releasing seat 56 is then held in place by a shear pin(s) 70. The release seat catcher 57 is made-up to the bottom shoe 62 and shear pin(s) 69 is inserted through the release seat catcher 57 into the mandrel 49. Finally, the bottom retainer 54 is made-up to the slip cage 53.

According to one embodiment of the invention, the depth verification tool 40 is set in a wellbore casing at a desired depth by a setting tool (not shown). The setting tool has two concentric mechanisms, wherein one engages the setting sleeve connector 41 and the other engages the top coupling 43. The setting tool sets the depth verification tool 40 in a wellbore casing by sliding the setting sleeve connector 41 and the top coupling 43 axially relative to each other. In particular, as shown in FIG. 10, the setting sleeve connector 41 is moved downward relative to the top coupling 43. This action shears the shear pin(s) 68, and moves the locking key mandrel 45 downward relative to the mandrel 49. Since the dogs 55 are pushed radially outward by the releasing seat 56 through holes in the mandrel 49, the dogs 55 engage the bottom of the bottom shoe 62 to hold the bottom shoe 62 stationary relative to the mandrel 49. Similarly, the spacer 48 is pushed by the locking key mandrel 45. Thus, when the setting sleeve connector 41 is moved downward relative to the top coupling 43, the spacer 8 and bottom shoe 62 squeeze the slip segments 60. The slip segments 60 are forced radially outward against the radially inward bias of the slip return springs 61, so that the slip segments 60 engage a wellbore casing in a set position. The locking key mandrel 45 locks the slip segments 60 in the set position by the body lock ring 44 which engage teeth on the exterior of the mandrel 49. According to different embodiments of the invention, setting tools (not shown) such as a hydraulic device, electromechanical device or any other device known to those of skill in the art may be used.

Figure 11A:
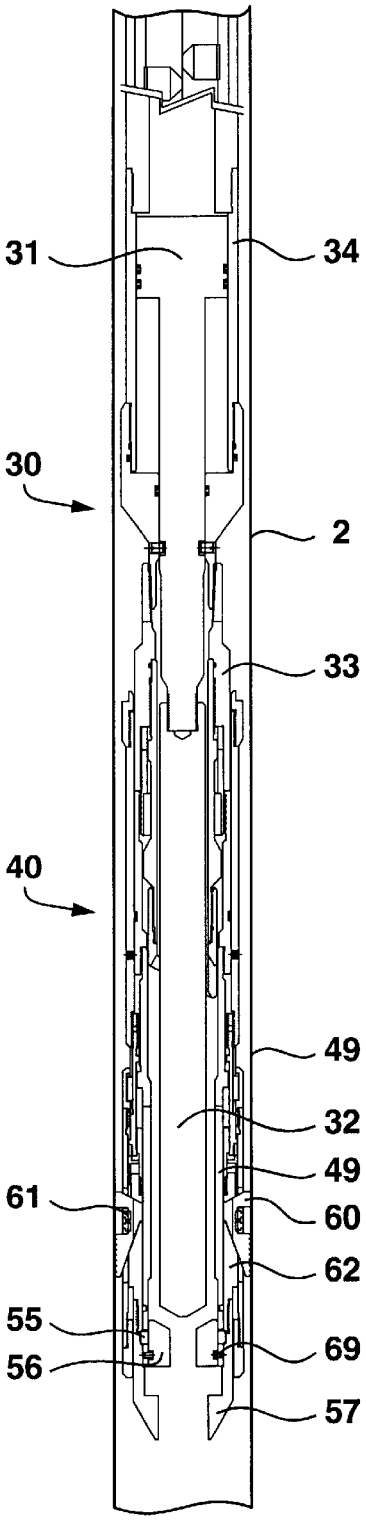
FIG. 11A is a side cross-sectional view of a depth verification tool and release mechanism. In this figure, the depth verification tool is shown in a set position.
Figure 11B:
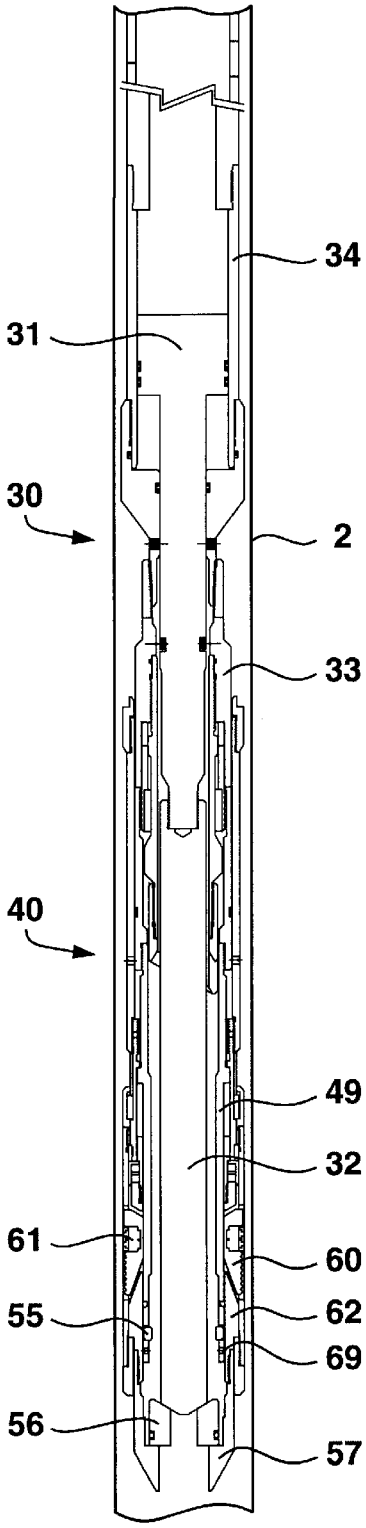
FIG. 11B is a side cross-sectional view of the depth verification tool and release mechanism shown in FIG. 11A. In this figure, the depth verification tool is shown in a release position.

Referring to FIGS. 11A and 11B, side cross-sectional views of a depth verification tool 40 and release mechanism 30 are shown, wherein FIG. 11A depicts a set position and FIG. 11B depicts a release position. The release mechanism 30 comprises a piston 31 which drives a plunger 32. The piston 31 slides within a piston cylinder 34. In one embodiment of the invention, the piston cylinder 34 of the release mechanism 30 is made-up to the bottom of the perforating apparatus 20 (see FIG. 3).

The release mechanism 30 further comprises a coupling 33 which makes-up to the top coupling 43 of the depth verification device 40. In particular, according to one embodiment of the invention described above, when the perforating apparatus 20 is deposited 103 on the depth verification tool 40 (see FIGS. 1 and 3), the coupling 33 of the release mechanism 30 mates with the top coupling 43 of the depth verification tool 40. Upon mating, the plunger 32 of the release mechanism 30 extends down through the center of the mandrel 49 of the depth verification tool 40.

According to one embodiment of the invention, when the release mechanism 30 is run-in 102 (see FIG. 1) the wellbore casing 2, the pressure in the piston cylinder 34 is atmospheric pressure. When the perforating apparatus 20 is detonated 108, pressure in the piston cylinder 34 increases because the casing is exposed to relatively higher pressure in the production zone 5 through the newly formed perforations 4 (see FIG. 5). The relatively higher hydrostatic pressure pushes the piston 31 in the piston cylinder 34 to move the plunger 32 downward (see FIGS. 11A and 11B). In an alternative embodiment, the pressure in the piston cylinder is increased by the explosion that occurs upon detonation of perforating guns. In a further embodiment, the pressure is increased by increasing the hydrostatic head of the completion fluid in the annulus of the well. In any case, as the plunger 32 moves downward, the distal end of the plunger 32 contacts the release seat 56 and exerts a downward force on the release seat 56. This downward force eventually surpasses the shear strength of the shear pin(s) 69 and the shear pin(s) 69 is sheared. The release seat 56 is then pushed downward relative to the mandrel 49 until it falls in the release seat catcher 57. With the release seat 56 removed from the mandrel 49, the dogs 55 are free to move radially inward so that the bottom shoe 62 is free to move axially downward. At this point, the bottom shoe 62 may fall downward due to gravity or it may be pushed by further downward movement of the plunger 32. In any case, the bottom shoe 62 is pulled from its set position behind the slip segments 60. With nothing to support the slip segments 60, the slip segments 60 are pushed radially inward by the slip return springs 61 to release the depth verification tool 40 from the wellbore casing 2. This allows the depth verification tool 40 and the perforating apparatus 20 to fall in the wellbore casing 2 as described above.

Figure 12:
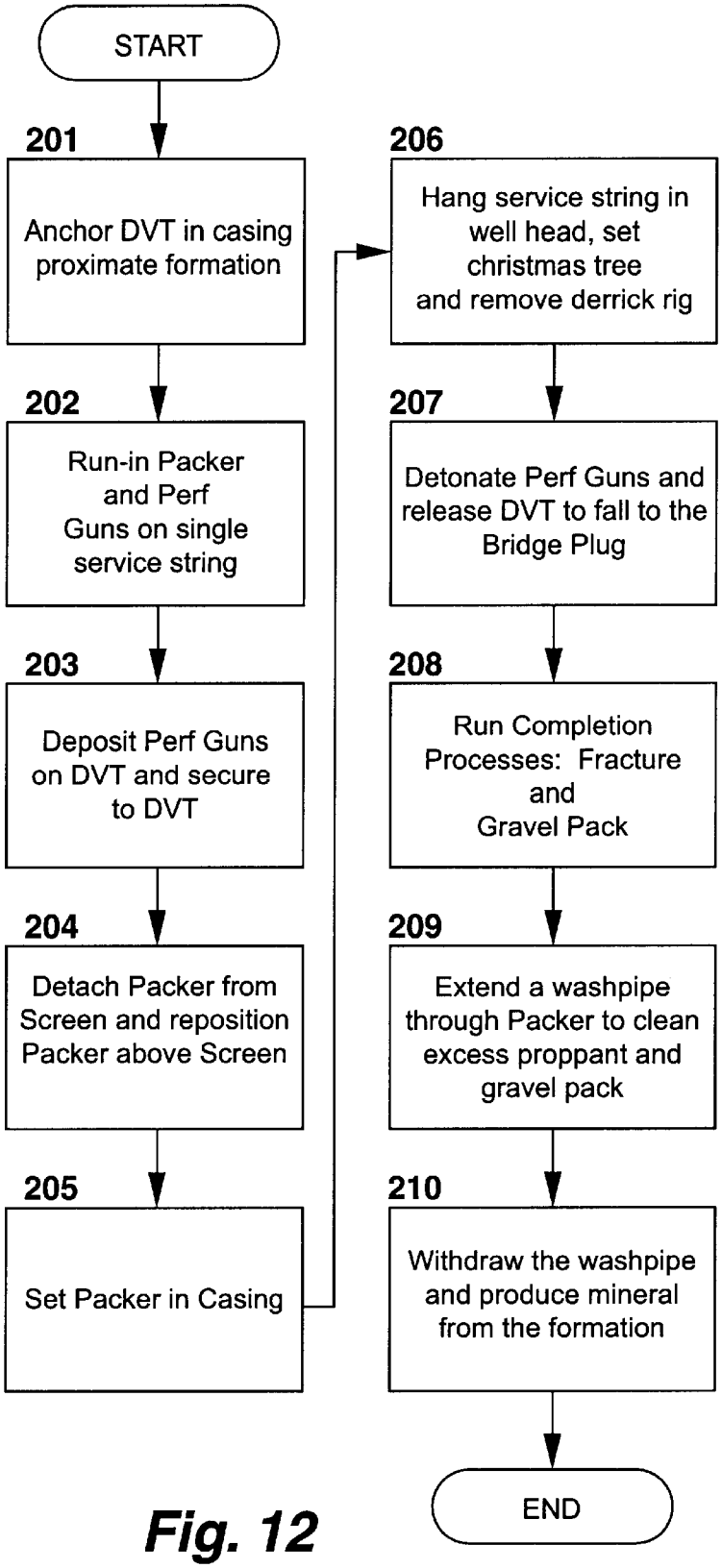
FIG. 12 is a flow chart of a method embodiment of the invention for perforating and gravel packing a wellbore casing.
Figure 13:
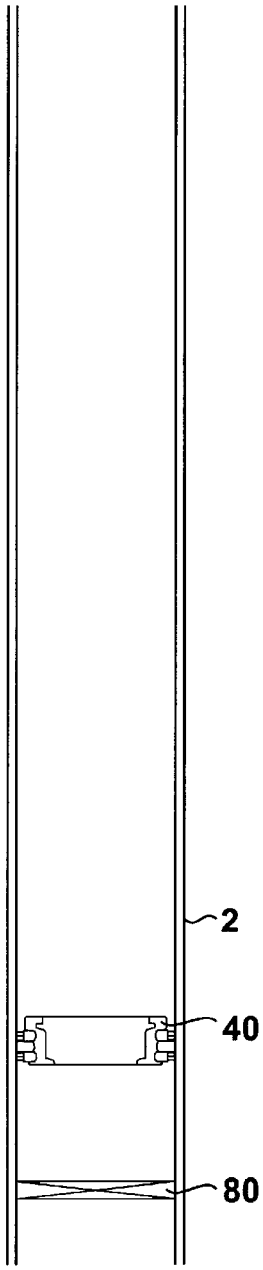
FIG. 13 is a sideview of a wellbore casing and a depth verification tool anchored in a casing having a plug. This is a "Set Depth Verification Tool" configuration.

Another embodiment of the invention is described with reference to FIGS. 12 through 18. FIG. 12 is a flow chart of describing a method for fracturing and packing a well casing, and FIGS. 13 through 18 illustrate cross sectional views of downhole tools in a wellbore casing at various stages of the method described in FIG. 12.

A sufficient rathole is established in the well adequate to house in the well casing a depth verification tool, a perforating gun assembly, a cup tool and a screen overlap. The bottom of the rathole is defined by formation material in the well casing or a bridge plug. In the embodiment shown in FIGS. 13–18, a bridge plug 80 defines the bottom of the rathole. An electric line (not shown) is run into the well casing 2 to anchor 201 the depth verification tool 40 below the perforation depth. After the electric wire line is removed, the service string 3 is picked up and run 202 into the well casing 2 with the perforation/completion system attached.

Figure 14:
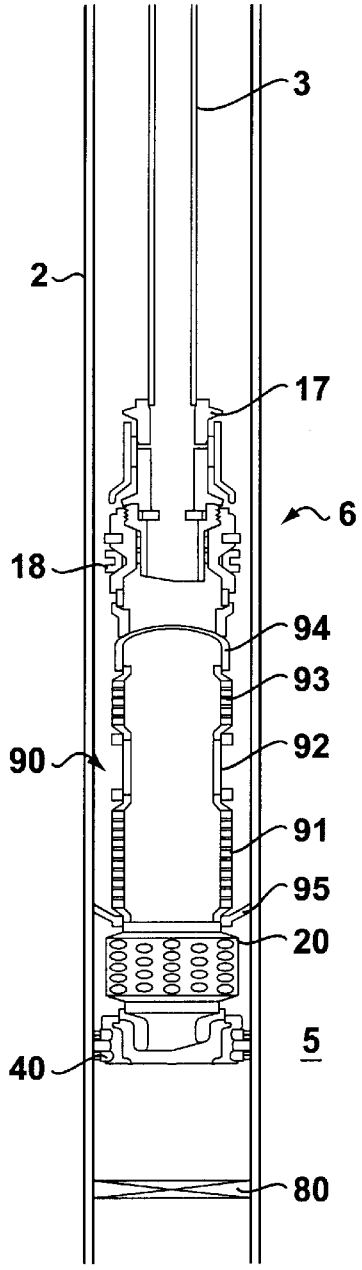
FIG. 14 is a sideview of a wellbore casing and depth verification tool anchored in the casing. Further, a gravel packer assembly and perforating apparatus are shown suspended from a pipe string in the well casing and seated on the top of the depth verification tool. This is a "Running" configuration.
Figure 15:
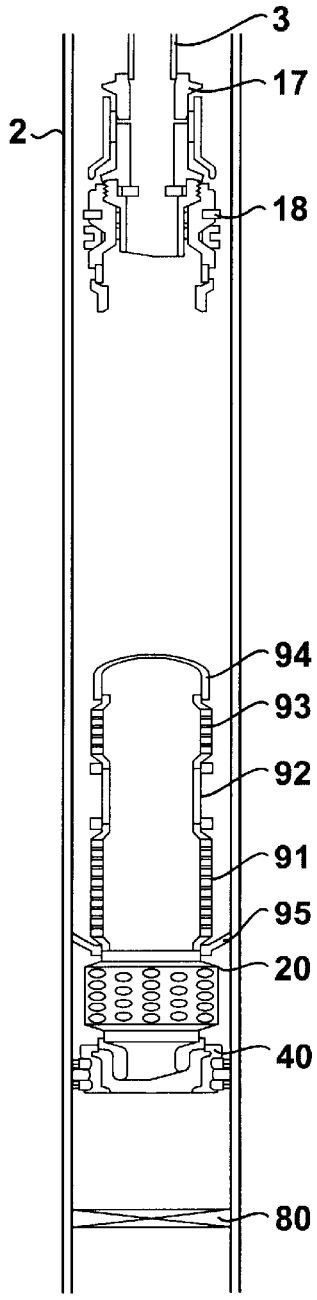
FIG. 15 is a sideview of a wellbore casing with an anchored depth verification tool, perforating apparatus and gravel packer assembly. The perforating apparatus has a production screen attached to its top and is secured at its bottom to the depth verification tool. The gravel packer assembly is detached from the production screen and is elevated to a position well above the perforating guns. This is a "Disengage" configuration.
Figure 16:
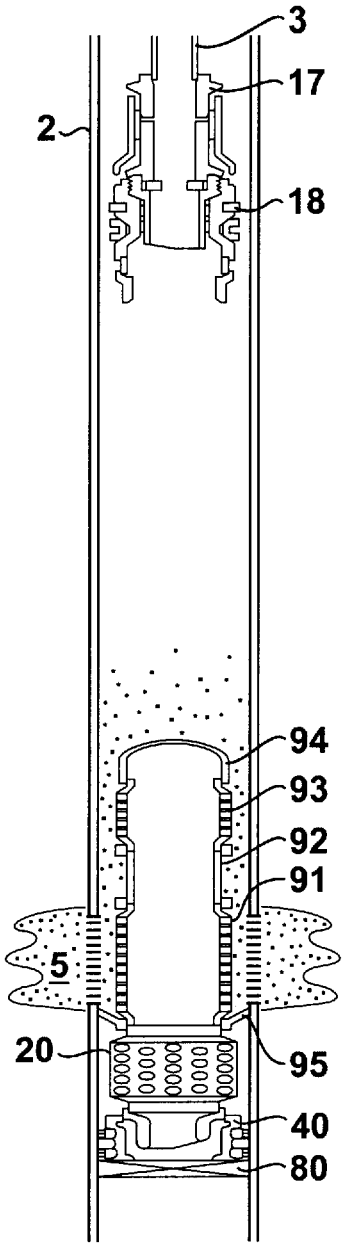
FIG. 16 is a sideview of a wellbore casing with a depth verification tool, perforating apparatus, and gravel packer assembly. The perforating gun has detonated to perforate the wellbore casing and the depth verification tool has released or unset from the casing so that the depth verification tool, perforating apparatus and production screen have fallen to rest on the plug. The production zone is gravel packed. This is a "Detonate/Pack" configuration.
Figure 17:
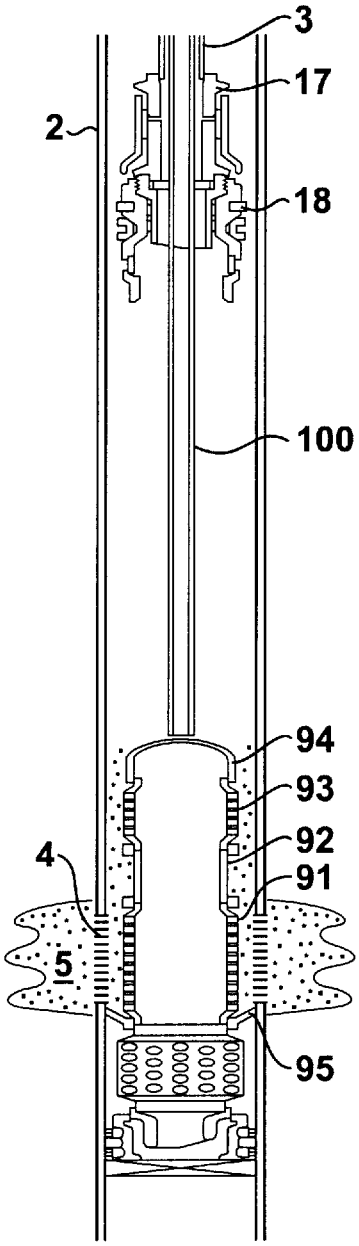
FIG. 17 is a sideview of a wellbore casing with a depth verification tool, perforating apparatus, and gravel packer assembly. A washpipe extends from the gravel packer assembly to complete the gravel pack around the production screen. This is the "Washout" configuration of the system.
Figure 18:
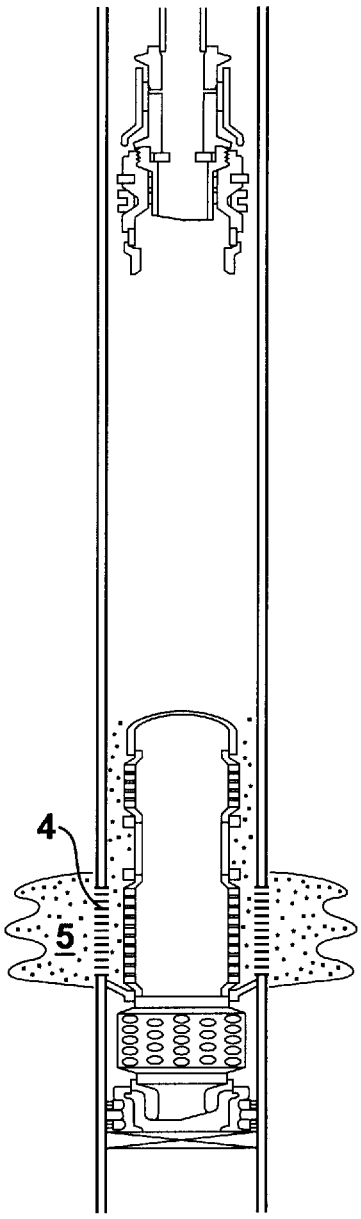
FIG. 18 is a sideview of a wellbore casing with a depth verification tool, perforating apparatus, and gravel packer assembly. The washpipe is withdrawn and the production fluids are allowed to flow through the gravel packer assembly. This is the "Production" configuration.

In this embodiment, the perforation/completion system 6 comprises the service tool 17, a packer 18, a screen overlap 90, and a perforating apparatus 20. These devices are made up to each other and run into the well together on the service string 3. The service string 3 is made of production pipe as described below. As shown in FIG. 14, the service tool 17 is made up to the lower end of the service string 3. The packer 18 is made up to the lower end of the service tool 17. At the lower end of the packer 18, there is attached the screen overlap 90. The screen overlap 90 has several components including: a cup tool 95, a production screen 91, a blank pipe 92, a vent screen 93, a nose plug 94. Finally, the perforating apparatus 20 is attached to the bottom of the screen overlap 90. Each of these components made be of any type known to persons of skill in the art.

The perforation/completion system 6 is run 202 into the well casing 2 until the perforating apparatus 20 is deposited 203 on and secured to the depth verification tool 40. The perforating apparatus 20 is secured or snapped 203 to the depth verification tool 40 (see FIG. 14) so that the perforating apparatus 20 is anchored in the well casing 2 adjacent the formation 5 to be produced. The packer 18 is then detached 204 from the screen overlap 90 and the service tool 17 and packer 18 are repositioned 204 up the well casing 2 from the screen overlap 90 and perforating apparatus 20 to a desired depth (see FIG. 15).

The packer 18 is then set 205 at the desired depth above the perforation depth. In one embodiment, a slickline (not shown) is run down the service string 3 to set a plug in a nipple below the packer 18. Pressure is then increased within the service string 3 (for example 2,500 psi) to set 207 the packer 18 in the well casing 2 at the desired depth. After the packer 18 is set, the service string 3 internal pressure is released. Pressure is then increased within the annulus between the service string 3 and the well casing 2 (for example 1,500 psi) to release the service tool 17 from the packer. The positive annulus pressure may also be used to test the integrity of the seal of the packer 18. After the service tool 17 is released from the packer 18, the annulus pressure is released. In alternative embodiments, any means known to persons of skill is used to set the packer 18. In any case, the packer 18 is set 207 in the well casing 2 at the desired depth.

With the packer 18 set in the well casing 2, the production tubing and Christmas tree are configured 206 at the well head and the rig is removed from the site. In one embodiment of the invention, the service string 3 (which also serves as the production tubing) is hung 206 from the well head. A nipple-up procedure is implemented to configure the Christmas tree to the top of the well head (not shown) as is known in the art. A tree saver, a stimulation vessel and a stimulation pump are made to communicate with the christmas tree. The rig (not shown) is removed since it is no longer needed at the well site. In this configuration, the annulus between the service string 3 and the well casing 2 is completely sealed by the packer 18 at the bottom and the christmas tree at the top. While this step of the process is herein described, it is to be noted that this step is not required in all embodiments of the invention. In some cases, the situation may demand that the rig remain on site.

Next, the perforation guns of the perforating apparatus 20 are detonated 207 to perforate the well casing 2. In one embodiment of the invention, pressure is built up and bleed off to detonate the guns. Alternatively, a drop ball, electric signal or any means known to persons of skill may be used to fire the guns. The detonation of the gun causes the depth verification tool 40 to release from the well casing 2 and fall in the well to the bridge plug 90. Of course, perforations 4 are formed in the well casing 2 adjacent the production formation 5 (see FIG. 16). The distance between the perforations 4 and the bridge plug 80 is made to correlate with the sizes of the tools so that when the tools fall in the well, the production screen 91 is adjacent the perforations 4.

A gravel pack and fracture procedure is then followed to treat 208 the well. In one embodiment, a gravel slurry is pumped down the service string 3. The slurry comprising proppant falls around the screen overlap 90 and out into the formation 5 through the perforations 4 in the well casing 2. The cup tool 95 is positioned below the production screen 91 to substantially prevent the slurry with proppant from flowing down around the perforating apparatus 20 and the depth verification device 40. Pressure is increased in the service string 2 to fracture the formation 5 and the proppant of the slurry prop open the fractures in the formation 5. The pressure is released. A sufficient amount of proppant is deposited in the annulus between the screen overlap 90 and the well casing 2 to pack the screen overlap 90. In an alternative embodiment, a first portion of the proppant is deposited to pack the production screen 91, a concrete plug is placed on top of the pack adjacent the blank pipe 92, and a second portion of proppant is deposited to pack the vent screen 93.

Since an excess amount of proppant is typically packed on top of the nose plug 94 of the screen overlap 90, the pack is washed 209 to remove the excess. For example, a wash pipe 100 comprising coil tubing is run into the service string 3 until the end of the wash pipe 100 is immediately above the top of the nose plug 94. The excess proppant is then pumped up the wash pipe 100. Once the excess proppant is removed, the wash pipe 100 is withdrawn from the service string 3. In alternative embodiments, it is not necessary to wash the excess proppant and/or gravel pack. Rather, the well is simply brought into production and the excess proppant and/or gravel pack will be produced with the initial product from the well.

The well is now ready to produce 210 minerals up the service string. The flow path for the production zone 5 is through the perforations 4, through the production screen 91 and into an interior of the screen overlap 90, up the interior of the blank pipe, out the vent screen 93 to the interior of the well casing 2, through the interior of the packer 18, and up the inside of the service string 3. While mineral may flow up the gravel packed annulus between the screen overlap 90 and the casing 2, the mineral will preferentially follow the path of least resistance which is through the interior of the screen overlap 90 as described. As noted above, the service string 3 and well head assemblies are properly configured even before the well casing is perforated. Thus, once the completion processes are finished, the well may be immediately brought into production.

This embodiment of the invention provides many benefits, depending on the particular well conditions. First, a gamma ray electric line run is eliminated as compared to other systems where a sump packer is run below the perforation depth, the casing is perforated, and a completion system is stung into the sump packer. Second, the system of the present invention eliminates cycle time because only two trips into the well are required: (1) an electric line run to set the depth verification tool, and (2) service string run to place perforation/completion system. Third, the need for a cross-over tool is eliminated because there is no recirculation during the gravel pack operation. Fourth, the Christmas tree is placed at the well head and the rig is removed before the casing is perforated. The christmas tree seals the annulus and the service string. The Christmas tree has a flange that seals off the casing. Fifth, since the Christmas tree and packer are set before perforation, there is no need to fill the well casing with heavier completion fluid. For example, typical completion system require 17 lbs. completion fluid in the well during perforation to prevent blow out in an overbalanced condition. This heavier fluid is very expensive and an isolation system must be rapidly installed to prevent the fluid from flowing out into the formation in an underbalanced condition. In the present invention, regular 11.6 lbs. completion fluid may remain in the well since the Christmas tree and packer are set prior to perforation. Further, even if there is an underbalanced condition, only the 11.6 lbs. completion fluid in the service string will flow to the formation and the completion fluid in the annulus is retained by the packer. Thus, unlike other systems, the present invention does not require a fluid loss device, such as a flapper valve or sliding sleeve to prevent fluid loss while production tubing is tripped into the well. Sixth, the present invention requires a very short rathole, for example, a depth equal to the combined length of the depth verification device and the perforating apparatus. Seventh, for reasons outlined above the present invention is recommendable in both overbalanced and underbalanced operations.

In an alternative embodiment, the depth verification device 40 is made up to the bottom of the perforating assembly 20 before the perforation/completion system 6 is run-in the well casing 2. This eliminates the need for the separate electric line trip into the well to set the depth verification tool 40.

In still another embodiment of the invention, the system comprises a gravel packer 10 having perforating and upper packers 11 and 12 as described above with reference to FIG. 3. The perforating packer 11 is attached at its bottom to the perforating apparatus 20 as previously described, but a screen overlap 90 is attached to its top. When the system is bottomed on the depth verification device, the upper packer 12 disconnects from the top of the screen overlap 90 for relocation up the well casing. Of course, in this embodiment, the screen overlap 90 does not comprise a nose plug 94 and the crossover tool assembly of the upper packer is stung into the screen overlap 90 and the production packer 11.

Figure 19:
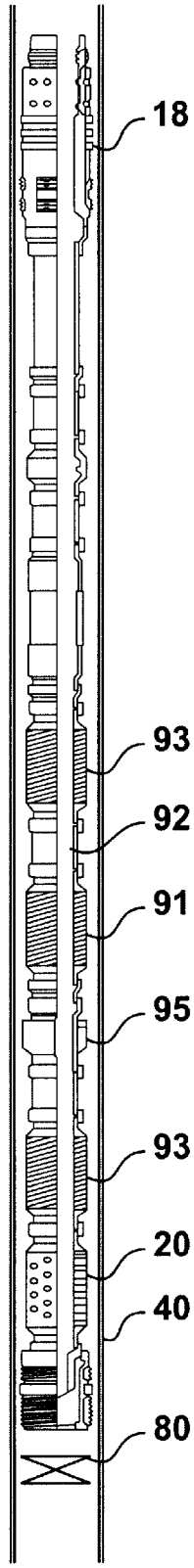
FIG. 19 is a sideview of an embodiment of the invention having a packer, screen, perforating apparatus and depth verification tool.

Referring to FIG. 19, a sideview of an embodiment of the invention is shown. A packer 18 is shown at the top and is connectable to a service string (not shown). A suitable packer is a Comp-Set 11 "HP" Rotational Lock Packer. Below the packer 18 and by several sections of pipes and connectors, a vent screen 93 is made-up to the packer 18. The vent screen 93 may be any screen or vent know to persons of skill, but in particular, it may be a wire wrap screen. There is also a production screen 91 and a blank pipe 92 between the two screens. Similarly, the production screen 91 may be any screen known to persons of skill, but in particular, it may be a micro-pack screen. Below the production screen 91, there is made-up a cup tool 95 which serves to keep particles from falling in the annulus below the cup tool 95. A second vent screen 93 is made up below the cup tool 95. At the bottom of the system, there is a perforation apparatus 20 and a depth verification tool 40. The second vent screen 93 (below the cup tool 95) enables the apparatus to fall freely in the casing after release by the depth verification tool 40. In particular, the second vent screen 93 allows fluid trapped below the cup tool 95 to pass through the interior of the system from below the cup tool 95 to above the cup tool 95. A bridge plug 80 is shown set in the casing below the system.

A further embodiment of the invention comprises a configuration similar to that shown in FIGS. 13–18. While the embodiment has a screen overlap 90 which is attached at its bottom to a perforating apparatus 20, the screen overlap 90 is not attached directly to the packer 18. Rather, the screen overlap 90 is connected to the packer 18 by a telescoping joint similar to the guide tube 50 shown in FIG. 9. There is no nose plug 94 between the screen overlap 90 and the telescoping joint. This telescoping joint has holes above the screen overlap 90 to communicate gravel pack material from the service string to the annulus. In operation, after the system is gravel packed, both the interior of the screen overlap 90 and the annulus will be full of gravel pack material. A washpipe 100 is then extended into the interior of the screen overlap 90 to wash the interior. The system is then ready for production.

While the particular embodiments for single-trip perforating/gravel packing systems and methods as herein shown and disclosed in detail are fully capable of obtaining the objects and advantages hereinbefore stated, it is to be understood that they are merely illustrative of the preferred embodiments of the invention and that no limitations are intended by the details of construction or design herein shown other than as described in appended claims.

| PARTS LIST | |
|---|---|
| 2 | Wellbore casing |
| 3 | Pipe string |
| 4 | Perforations |
| 6 | perforation/completion system |
| 5 | Production formation |
| 10 | Gravel packer |
| 11 | Perforation packer |
| 12 | Upper packer |
| 13 | Production screen |
| 14 | Fracturing sleeve |
| 15 | Cross-over tool |
| 16 | Through path |
| 17 | Service Tool |
| 18 | Packer |
| 20 | Perforating apparatus |
| 21 | Gun cylinder |
| 22 | Detonator |
| 30 | Release mechanism |
| 31 | Piston |
| 32 | Plunger |
| 33 | Coupling |
| 34 | Piston cylinder |
| 40 | Depth verification tool |
| 41 | Setting sleeve connector |
| 42 | Setting sleeve |
| 43 | Top coupling |
| 44 | Body lock ring |
| 45 | Locking key mandrel |
| 46 | Key |
| 47 | Upper retainer |
| 48 | Spacer |
| 49 | Mandrel |
| 50 | Guide tube |
| 51 | Gravel pack cylinder |
| 52 | Detonation cylinder |

-continued

| PARTS LIST | |
|---|---|
| 53 | Slip cage |
| 54 | Bottom retainer |
| 55 | Dogs |
| 56 | Releasing seat |
| 57 | Release seat catcher |
| 60 | Slip segments |
| 61 | Slip return springs |
| 62 | Bottom shoe |
| 68 | Shear pin(s) |
| 69 | Shear pin(s) |
| 70 | Shear pin(s) |
| 80 | Bridge Plug |
| 90 | Screen Overlap |
| 91 | Production Screen |
| 92 | Blank Pipe |
| 93 | Vent Screen |
| 94 | Nose Plug |
| 95 | Cup Tool |
| 100 | Wash Pipe |

What is claimed is:

1. A method of perforating and gravel packing a wellbore casing, said method comprising:

making-up to a pipe string: a packer, a screen, and a perforating apparatus;

running-in the pipe string until the perforating apparatus is at a depth of intended perforations;

setting the perforating apparatus in the wellbore casing at a depth of intended perforations;

disconnecting the screen and perforating apparatus from the pipe string;

relocating the packer to a position separate from the screen and perforating apparatus;

perforating the casing with the perforation assembly; and unsetting the perforating apparatus from the wellbore casing, whereby the screen and perforating apparatus are allowed to fall in the casing to a screen position adjacent perforations in the casing.

2. A method as claimed in claim 1, wherein said making-up comprises:

connecting an upper end of the packer to the pipe string;

connecting an upper end of the screen to the lower end of the packer; and connecting an upper end of the perforating apparatus to a lower end of the screen.

3. A method as claimed in claim 1, wherein said setting the perforating apparatus in the wellbore casing comprises:

setting a depth verification tool in the wellbore prior to said running-in the pipe string; and securing the perforating apparatus to the depth verification tool.

4. A method as claimed in claim 1, wherein said making-up further comprises connecting the depth verification tool to the perforating apparatus, wherein said setting the perforating apparatus in the wellbore casing at a depth of intended perforations comprises anchoring the depth verification tool in the casing.

5. A method as claimed in claim 1, wherein said relocating the packer to a position separate from the screen and perforating apparatus comprises pulling up the pipe string, whereby the gravel packer assembly is positioned uphole from the perforating apparatus, and wherein said method further comprises setting the packer and assembling a christmas tree at a wellhead of the wellbore casing.

6. A method as claimed in claim 1, wherein said perforating the casing with the perforation assembly comprises detonating perforating guns.

7. A method as claimed in claim 1, wherein said setting the perforating apparatus in the wellbore casing comprises:

setting a depth verification tool in the wellbore prior to said running-in the pipe string; and securing the perforating apparatus to the depth verification tool; and wherein said unsetting the perforating apparatus from the wellbore casing comprises:

unsetting the depth verification tool, whereby the depth verification tool, the screen, and the perforating apparatus fall in the casing.

8. A method as claimed in claim 1, wherein said perforating the casing and said unsetting the perforating apparatus are substantially simultaneous.

9. A method as claimed in claim 1, further comprising gravel packing the screen.

10. A system for perforating and gravel packing a wellbore casing, said system comprising:

a packer which is mechanically communicable with a service string:

a screen in mechanical communication with said packer;

a perforating apparatus in mechanical communication with said screen, wherein said screen and perforating apparatus are detachable from said packer;

a tool having at least one casing engaging slip segment, wherein said tool is matable with said perforating apparatus, and wherein said tool is settable in the wellbore casing; and a release mechanism of said tool from being set in the casing, wherein said release mechanism comprises a piston and a plunger, wherein said piston drives said plunger to release said tool from being set in the casing.

11. A system as claimed in claim 10, wherein said packer has a through path extending from a top end to a bottom end of said packer.

12. A system as claimed in claim 10, wherein said screen comprises a production screen, a blank pipe and a vent screen.

13. A system as claimed in claim 10, wherein said perforating apparatus comprises a detonator and at least one perforating gun.

14. A system as claimed in claim 10, wherein said tool is settable in the casing on a wire line and said perforating apparatus is matable to said tool when run-in the wellbore on a service string.

15. A system as claimed in claim 10, further comprising a bridge plug which is settable in the casing below a desired perforation depth.

16. A system for perforating and gravel packing a wellbore casing, said system comprising:

a packer connectable to a pipe string for running said system into the casing, wherein said packer has a through path extending from a top end to a bottom end of said packer;

a screen comprising a production screen and a vent screen, wherein said screen mechanically communicates with said packer;

a perforating apparatus in mechanical communication with said packer, wherein said perforating apparatus and said screen are detachable from said packer; and a tool comprising at least one casing engaging slip segment and a release mechanism, wherein said tool is matable with said perforating apparatus, and wherein said tool is settable in the wellbore casing.

17. A system for perforating and gravel packing a wellbore casing, said system comprising:

a packer connectable to a pipe string for running said system into the casing, wherein said packer has a through path extending from a top end to a bottom end of said packer;

a screen comprising a production screen and a vent screen, wherein said screen mechanically communicates with said packer;

a perforating apparatus in mechanical communication with said packer, wherein said perforating apparatus and said screen are detachable from said packer; and a tool comprising at least one casing engaging slip segment and a release mechanism, wherein said tool is matable with said perforating apparatus, and wherein said tool is settable in the wellbore casing; and a tube that is extendable between said packer and said perforating apparatus, whereby a drop bar is guided from said packer to said perforating apparatus.

* * * * *